US010222105B2

(12) United States Patent
Christians

(10) Patent No.: US 10,222,105 B2
(45) Date of Patent: Mar. 5, 2019

(54) REFRIGERANT DISTRIBUTOR FOR FALLING FILM EVAPORATOR

(71) Applicant: Carrier Corporation, Jupiter, FL (US)

(72) Inventor: Marcel Christians, Skaneateles, NY (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 15/111,849

(22) PCT Filed: Jan. 14, 2015

(86) PCT No.: PCT/US2015/011298

§ 371 (c)(1),
(2) Date: Jul. 15, 2016

(87) PCT Pub. No.: WO2015/108902

PCT Pub. Date: Jul. 23, 2015

(65) Prior Publication Data

US 2016/0341457 A1 Nov. 24, 2016

Related U.S. Application Data

(60) Provisional application No. 61/927,527, filed on Jan. 15, 2014.

(51) Int. Cl.
*F28F 25/04* (2006.01)
*F25B 39/02* (2006.01)
(Continued)

(52) U.S. Cl.
CPC ..... *F25B 39/028* (2013.01); *F28D 3/02* (2013.01); *F28D 3/04* (2013.01); *F28F 9/0207* (2013.01);
(Continued)

(58) Field of Classification Search
CPC .. F25B 39/028; F25B 2339/0242; F28D 3/00; F28D 3/04; F28D 5/02; F28D 3/02;
(Continued)

(56) References Cited

U.S. PATENT DOCUMENTS 2,305,114 A * 12/1942 Sisson ..... F25D 3/06 62/241
4,216,002 A 8/1980 Rosenblad
(Continued)

FOREIGN PATENT DOCUMENTS

CN 201983533 U 9/2011
CN 102252468 A 11/2011
(Continued)

OTHER PUBLICATIONS

Notification of Transmittal of the International Search Report and the Written Opinion of the International Searching Authority, of the Declaration; Application No. PCT/US2015/011298; dated Mar. 25, 2015; 10 pages.

*Primary Examiner* — Hung Q Nguyen
*Assistant Examiner* — Mark L Greene
(74) *Attorney, Agent, or Firm* — Cantor Colburn LLP

(57) ABSTRACT

A heating, ventilation and air conditioning (HVAC) system includes a condenser (18) flowing a flow of refrigerant therethrough, and a falling film evaporator (12) in flow communication with the condenser. The falling film evaporator includes a plurality of evaporator tubes (38) through which a volume of thermal energy transfer medium is flowed and a distributor (42) to distribute a flow of liquid refrigerant over the plurality of evaporator tubes. The distributor includes a distributor box (46) and a distribution sheet (48) positioned at a bottom surface of the distributor box having a plurality of ports (56) therein to distribute the flow of liquid refrigerant downwardly over the plurality of evaporator tubes. A plurality of baffles (56) is positioned at the
(Continued)

distribution sheet to divide the distributor box into a plurality of compartments to ensure a homogeneous flow of the liquid refrigerant is delivered through the plurality of ports.

8 Claims, 6 Drawing Sheets

(51) Int. Cl.
*F28F 9/02* (2006.01)
*F28D 3/02* (2006.01)
*F28D 3/04* (2006.01)

(52) U.S. Cl.
CPC ..... *F28F 9/0273* (2013.01); *F28F 25/04* (2013.01); *F25B 2339/0242* (2013.01)

(58) Field of Classification Search
CPC ..... F28F 9/0265; F28F 9/0268; F28F 25/02; F28F 25/04; F28F 25/06; F28F 25/08; F28F 25/085; F28F 9/0273; F28F 9/0278; F28F 9/0202; F28F 9/0204; F28F 9/0207
See application file for complete search history.

(56) References Cited

U.S. PATENT DOCUMENTS 4,564,064 A 1/1986 Allo et al.
4,567,942 A 2/1986 Stafford et al.
4,925,526 A 5/1990 Havukainen
4,932,468 A 6/1990 Ayub
4,944,839 A 7/1990 Rosenblad
5,590,710 A * 1/1997 Sasaki ..... F28F 9/0207 165/173
6,089,312 A 7/2000 Briar et al.
6,253,571 B1 7/2001 Fujii et al.
6,516,627 B2 2/2003 Ring et al.
6,868,695 B1 3/2005 Dingel et al.
7,849,710 B2 12/2010 Larminat et al.
9,677,818 B2 * 6/2017 Numata ..... F28D 15/00
9,759,461 B2 * 9/2017 Numata ..... F25B 39/028
2004/0112573 A1 * 6/2004 Moeykens ..... F25B 39/028 165/115
2009/0178790 A1 7/2009 Schreiber et al.
2013/0206343 A1 8/2013 Artamo et al.
2013/0277019 A1 * 10/2013 Numata ..... F25B 39/02 165/157
2013/0277020 A1 * 10/2013 Numata ..... F28F 25/02 165/157
2015/0013951 A1 * 1/2015 Numata ..... F28D 15/00 165/157
2017/0138652 A1 * 5/2017 Hattori ..... F25B 39/00

FOREIGN PATENT DOCUMENTS

CN 203083207 U 7/2013
EP 1030154 A2 4/2005

* cited by examiner

REFRIGERANT DISTRIBUTOR FOR FALLING FILM EVAPORATOR

BACKGROUND

The subject matter disclosed herein relates to heating, ventilation and air conditioning (HVAC) systems. More specifically, the subject matter disclosed herein relates to falling film evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes, utilizing gravity to drive the flow of refrigerant over the evaporator tubes. Evaporation is primarily accomplished through thin film evaporation on the surface of the evaporator tubes, while a small fraction of refrigerant is boiled off in a pool boiling section of the evaporator.

One of the advantages of gravity feed is that the falling liquid film can be very precisely located such that the risk of maldistribution on the tubes is lowered. The main disadvantage arises from the requirements of gravity feed itself; a stable liquid level needs to be maintained in the distributors such that all of the orifices in the distributor box see the same hydrostatic pressure and deliver the same amount of refrigerant to the tubes below. Furthermore, it is intended that the implementation of falling film technology should not increase the footprint requirements vs. existing flooded products, nor should it increase the amount of liquid refrigerant stored in the distribution system. This limits the height of liquid film that can be used, which in turn increases the possibility that the flow through the orifices will be uneven, since a small change in liquid level height within the distributor (due to, for example, slanted or unlevel installation, or shifting during operation) will have a larger effect than in systems with more generous liquid level allowances.

BRIEF SUMMARY

In one embodiment, a heating, ventilation and air conditioning (HVAC) system includes a condenser flowing a flow of refrigerant therethrough, and a falling film evaporator in flow communication with the condenser. The falling film evaporator includes a plurality of evaporator tubes through which a volume of thermal energy transfer medium is flowed and a distributor to distribute a flow of liquid refrigerant over the plurality of evaporator tubes. The distributor includes a distributor box and a distribution sheet positioned at a bottom surface of the distributor box having a plurality of ports therein to distribute the flow of liquid refrigerant downwardly over the plurality of evaporator tubes. A plurality of baffles is positioned at the distribution sheet to divide the distributor box into a plurality of compartments to ensure a homogeneous flow of the liquid refrigerant is delivered through the plurality of ports.

In another embodiment, a falling film evaporator includes a plurality of evaporator tubes through which a volume of thermal energy transfer medium is flowed and a distributor to distribute a flow of liquid refrigerant over the plurality of evaporator tubes. The distributor includes a distributor box and a distribution sheet positioned at a bottom surface of the distributor box having a plurality of ports therein to distribute the flow of liquid refrigerant downwardly over the plurality of evaporator tubes. A plurality of baffles is positioned at the distribution sheet to divide the distributor box into a plurality of compartments to ensure a homogeneous flow of the liquid refrigerant is delivered through the plurality of ports.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
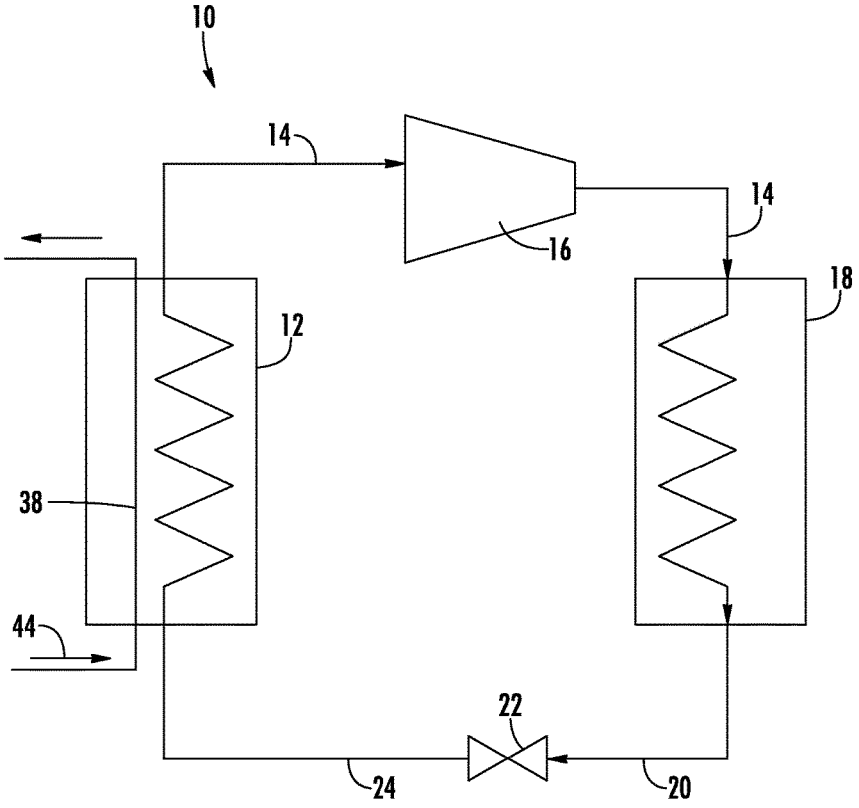
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12.

Figure 2:
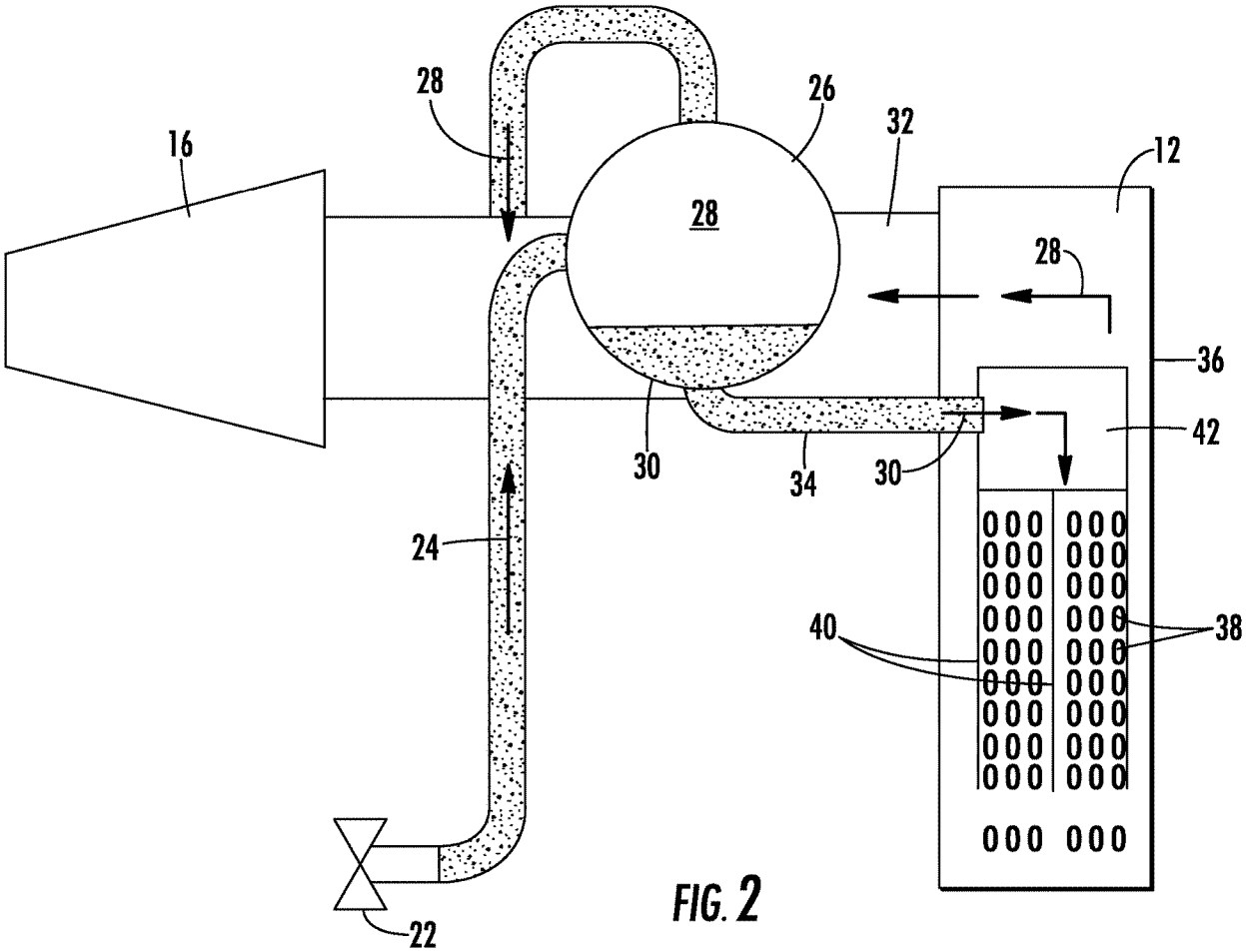
FIG. 2 is a schematic view of an embodiment of a falling film evaporator for an HVAC system.

Referring now to FIG. 2, as stated above, the evaporator 12 is a falling film evaporator. A separator 26 is located upstream of the evaporator 12 to separate the vapor refrigerant 28 and liquid refrigerant 30 components from the vapor and liquid refrigerant mixture 24 flowing from the expansion valve 22. Vapor refrigerant 28 is flowed to an evaporator suction line 32 and returned to the compressor 16. Liquid refrigerant 30 is flowed via refrigerant input line 34 into the evaporator 12. Although the separator 26 is shown in this embodiment to be located outside of the evaporator 12, it is to be appreciated that in other embodiments the separator may be located within the evaporator 12. The evaporator 12 includes housing 36 with the evaporator 12 components disposed at least partially therein, including a plurality of evaporator tubes 38 grouped into tube bundles 40. A distributor 42 is located above the tube bundles 30 to distribute the liquid refrigerant 30 over the tube bundles 40. A thermal energy exchange occurs between a flow of heat transfer medium 44 flowing through the evaporator tubes 38 into and out of the evaporator 12 and the liquid refrigerant 30. As the liquid refrigerant 30 is boiled off in the evaporator 12, the resulting vapor refrigerant 28 is directed to the compressor 16 via the suction line 32. While the evaporator 12 shown is rectangular in cross-section, one skilled in the art will appreciate that the evaporator 12 may be a variety of shapes, including spherical, cylindrical, rectilinear or any combination of shapes such as these.

Figure 3:
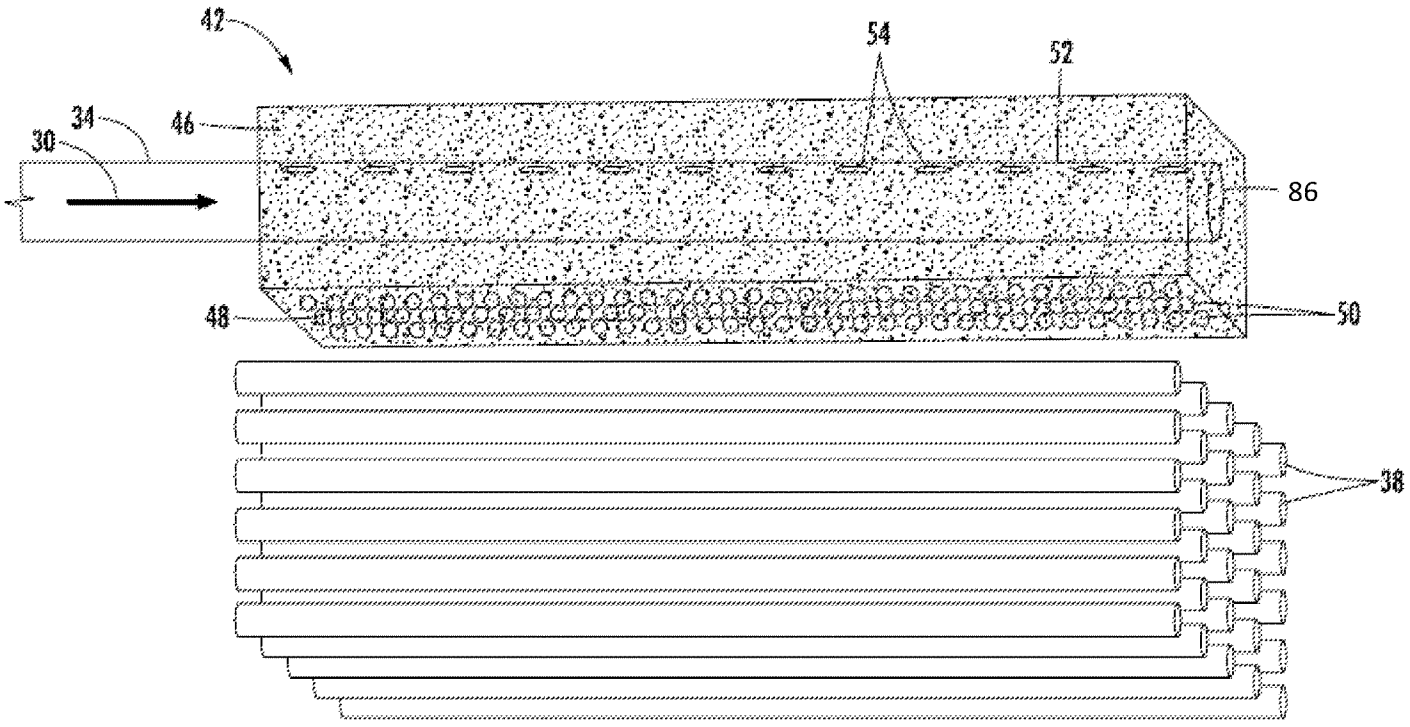
FIG. 3 is a perspective view of an embodiment of a falling film evaporator for an HVAC system.

An embodiment of a distributor 42 is shown in FIG. 3. The distributor 42 includes a distributor box 46 having a distribution sheet 48 with a plurality of ports 50 arranged in it. In some embodiments, the distribution sheet 48 is located at a bottom surface of the distributor box 46. The liquid refrigerant 30 is flowed into the distributor box 46 via the refrigerant input line 34 and through a sparge pipe 52 with sparge openings 54 arranged on an upper portion 86 of the sparge pipe 52. The liquid refrigerant 30 flows out of the sparge openings 54 into the distributor box 46 and out through the ports 50. A typical distributor relies only on hydrostatic head to urge liquid refrigerant through the ports 50.

Figure 4:
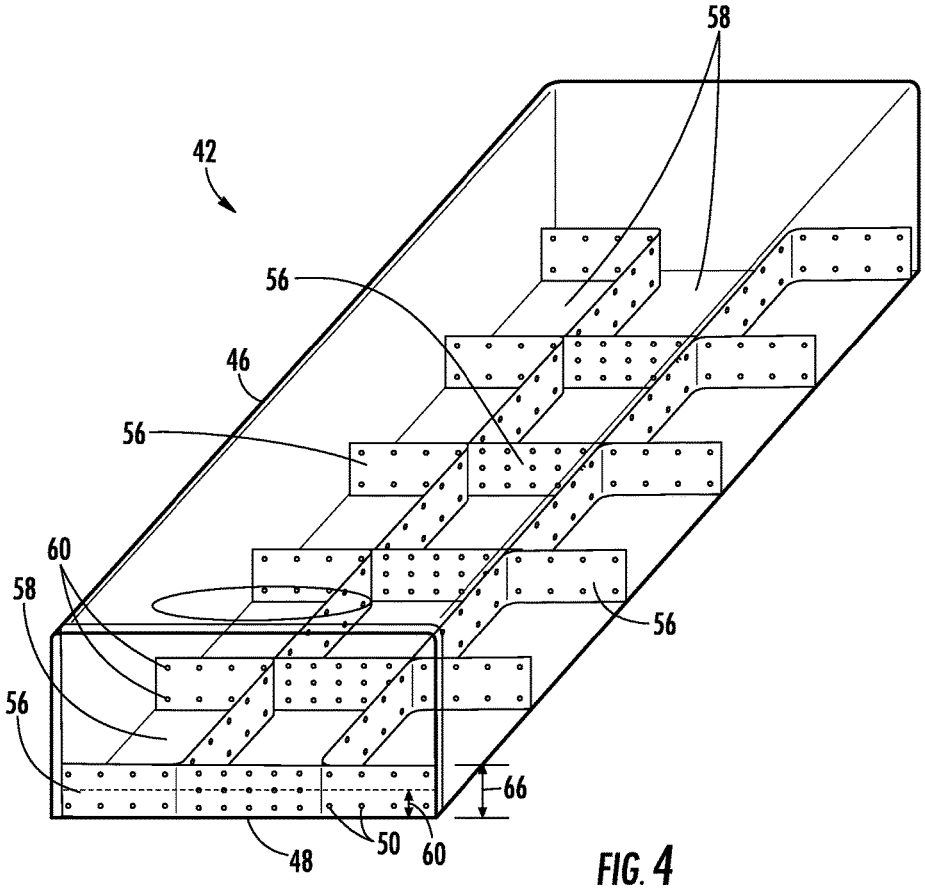
FIG. 4 is a perspective view of an embodiment of a distributor box for a falling film evaporator.
Figure 5:
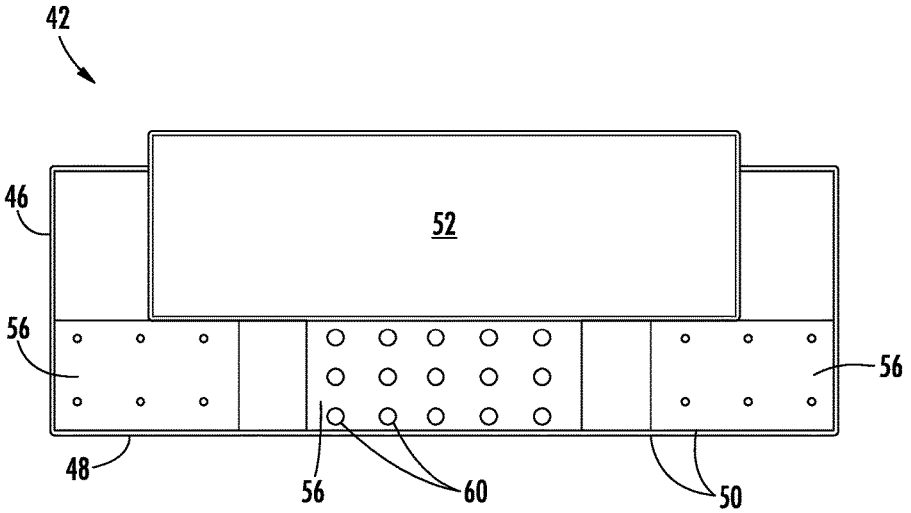
FIG. 5 is an end view of an embodiment of a distributor box for a falling film evaporator.

Referring now to FIG. 4, to increase uniformity of distribution of the liquid refrigerant 30 and reduce the refrigerant charge or size of evaporator necessary to handle high loads and/or allow for unlevel installation of the evaporator 12, the distributor box 46 includes a plurality of baffles 56 disposed below the sparge pipe 52 (shown in FIG. 5) separating the distributor box into a plurality of compartments 58. A baffle height 66 is greater than a liquid refrigerant height 68 in the distributor box 46. As shown in FIG. 5, the baffles 56 include perforations 60 or other openings to allow flow of liquid refrigerant 30 between compartments 58, but the baffles 56 provide sufficient flow resistance to prevent large differences in liquid refrigerant 30 levels between compartments 58. Thus, the liquid refrigerant 30 flow delivered through the ports 50 in the distribution sheet 48 is homogenous and ensures stable operation of the evaporator 12. In some embodiments, the perforations 60 have diameters in the range of about 0.25" to 0.50". Further, while circular perforations 60 are shown in FIG. 5, it is to be appreciated that elongated slots or other shapes of perforations 60 may be utilized. Alternatively, the baffles 56 may be formed from a porous material such as an open-celled foam.

Figure 6:
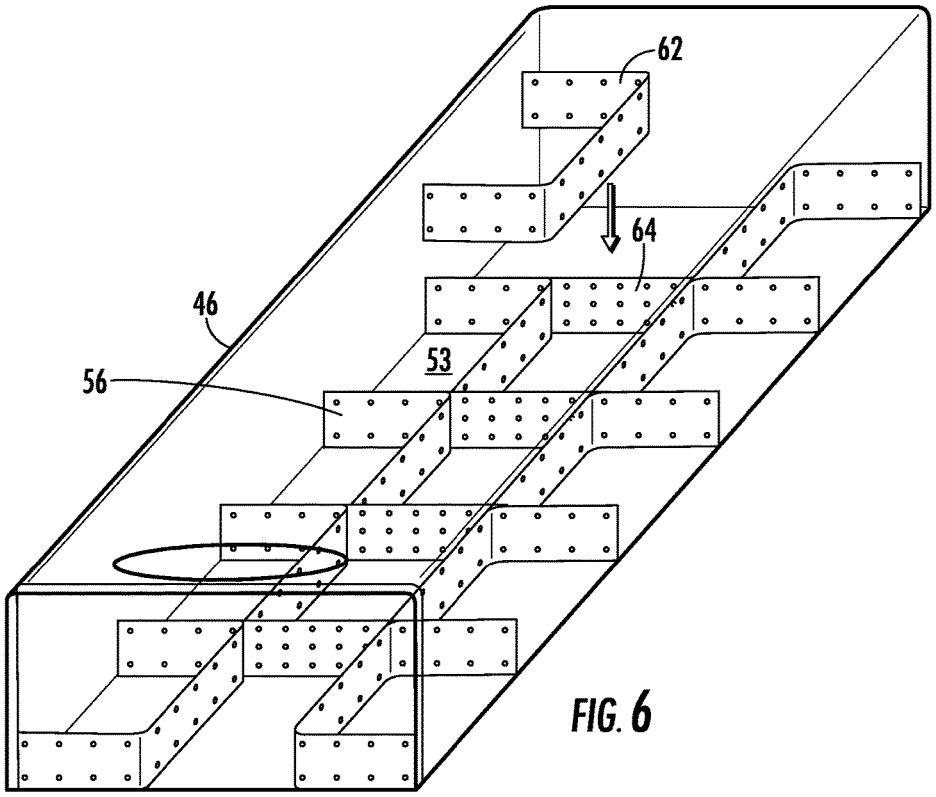
FIG. 6 is a partially exploded view of an embodiment of a distributor box for a falling film evaporator.

Referring now to FIG. 6, the baffles 56 may be U-shaped plates 62 placed on the distribution sheet 48 and arranged along a length of the distributor box 46. The U-shaped plates 62 may be used alone or in combination with other baffle elements, for example, flat plates 64 to form a selected number of compartments 58 of a desired shape and size in the distributor box 46.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:

a condenser flowing a flow of refrigerant therethrough;

a falling film evaporator in flow communication with the condenser including:

a plurality of evaporator tubes through which a volume of thermal energy transfer medium is flowed;

a distributor to distribute a flow of liquid refrigerant over the plurality of evaporator tubes, the distributor including:

a distributor box;

a distribution sheet disposed at a bottom surface of the distributor box having a plurality of ports disposed therein to distribute the flow of liquid refrigerant downwardly over the plurality of evaporator tubes; and a plurality of baffles disposed at the distribution sheet to divide the distributor box into a plurality of compartments to ensure a homogeneous flow of the liquid refrigerant is delivered through the plurality of ports, the plurality of baffles comprising a plurality of U-shaped plates disposed at the distribution sheet, the plurality of baffles further including a plurality of perforations;

wherein at least one of the plurality of U-shaped plates is formed from a separate bent plate and consists of a first leg portion extending from one end of a base portion, and a second leg portion extending from the other end of the base portion; and wherein edges of the first leg portion, the base portion, and the second leg portion of the at least one of the plurality of U-shaped plates contact the distribution sheet.

2. The HVAC system of claim 1, wherein the plurality of perforations are circular.

3. The HVAC system of claim 1, wherein a baffle height from the distribution sheet is greater than a liquid refrigerant height from the distribution sheet.

4. The HVAC system of claim 1, wherein the plurality of baffles further comprises a plurality of flat plates disposed at the distribution sheet.

5. A falling film evaporator comprising:

a plurality of evaporator tubes through which a volume of thermal energy transfer medium is flowed;

a distributor to distribute a flow of liquid refrigerant over the plurality of evaporator tubes, the distributor including:

a distributor box;

a distribution sheet disposed at a bottom surface of the distributor box having a plurality of ports disposed therein to distribute the flow of liquid refrigerant downwardly over the plurality of evaporator tubes; and a plurality of baffles disposed at the distribution sheet to divide the distributor box into a plurality of compartments to ensure a homogeneous flow of the liquid refrigerant is delivered through the plurality of ports, the plurality of baffles comprising a plurality of U-shaped plates disposed at the distribution sheet, the plurality of baffles further including a plurality of perforations;

wherein at least one of the plurality of U-shaped plates is formed from a separate bent plate and consists of a first leg portion extending from one end of a base portion, and a second leg portion extending from the other end of the base portion; and wherein edges of the first leg portion, the base portion, and the second leg portion of the at least one of the plurality of U-shaped plates contact the distribution sheet.

6. The falling film evaporator of claim 5, wherein the plurality of perforations are circular.

7. The falling film evaporator of claim 5, wherein a baffle height from the distribution sheet is greater than a liquid refrigerant height from the distribution sheet.

8. The falling film evaporator of claim 5, wherein the plurality of baffles further comprises a plurality of flat plates disposed at the distribution sheet.

* * * * *